United States Patent [19]

Markham et al.

[11] 4,176,610

[45] Dec. 4, 1979

[54] SAFE DEPOSIT APPARATUS

[75] Inventors: Michael H. Markham, Rexdale; Rudolf S. Ruston, Oakville, both of Canada

[73] Assignee: Chubb Industries Limited, Brampton, Canada

[21] Appl. No.: 941,584

[22] Filed: Sep. 12, 1978

[51] Int. Cl.[2] ..... E05G 1/026

[52] U.S. Cl. ..... 109/59 R; 109/66; 109/73; 232/44

[58] Field of Search ..... 109/59, 66, 73; 232/43.3, 44, 47, 57

[56] References Cited

U.S. PATENT DOCUMENTS

| | | | |
|---|---|---|---|
| 2,581,621 | 1/1952 | Behrens et al. | 232/44 |
| 2,617,584 | 11/1952 | Behrens | 232/44 |
| 2,776,090 | 1/1957 | Wright | 232/44 |
| 3,465,955 | 9/1969 | DeBoer et al. | 232/44 |
| 3,762,634 | 10/1973 | Leipelt | 232/44 |
| 3,784,090 | 1/1974 | Markham | 232/44 |
| 4,063,520 | 12/1977 | Parsons | 109/66 |

*Primary Examiner*—David H. Corbin

*Attorney, Agent, or Firm*—Ridout & Maybee

[57] ABSTRACT

In a safe deposit apparatus of the type having a horizontally pivoted sector-shaped door with an interior pocket formed by a pivoted wall serving to eject articles from the pocket when the door is closed, the pivoted wall is normally biassed to the pocket-forming position and is displaceable therefrom to the ejecting position by a cam arrangement which becomes operable as the door is closed. Another cam arrangement maintains the pivoted wall in the ejecting position during opening the door. A locking mechanism permits opening of the door to a first position at which envelopes may be deposited, but prevents opening to a second position for the deposition of wallets except when released by a user's key.

13 Claims, 7 Drawing Figures

SAFE DEPOSIT APPARATUS

FIELD OF THE INVENTION

This invention relates to safe deposit apparatus, for example night depositories for banks. The invention is concerned particularly with safe deposit apparatus of the kind comprising a casing defining a door compartment having a frontal access opening and a rear discharge opening, a sector-shaped door therein horizontally pivoted at its apex axis near the bottom of the access opening, the door having a handle on its outer angle side for moving the door between closed and open positions, and a movable wall member horizontally pivoted near the peripheral corner of the other and inner angle side of the door, the wall member forming an interior pocket in the door for the reception of articles deposited through the access opening when the door is in open position, and being pivotally movable from the first or pocket-forming position to a second or ejecting position when the door is closed to eject articles from the pocket via the rear discharge opening. A safe deposit apparatus of this kind is disclosed in U.S. Pat. No. 4,063,520 dated Dec. 20, 1977 in the name Kenneth A. Parsons.

BACKGROUND OF THE INVENTION

In a safe deposit apparatus of the kind referred to it is necessary to provide for movement of the pivoted wall member between its first and second positions automatically in response to opening and closing of the door, so that the pocket is formed to receive envelopes and wallets when the door is opened and so that the wall is displaced to eject the articles when the door is closed. The movements of the movable wall must be coordinated with the movements of the door to ensure positive transfer of the deposited articles and positive ejection of articles from the pocket so as to prevent retrieval by unauthorized persons. Furthermore, it is generally convenient to provide separate facilities for the deposition of envelopes and the deposition of wallets such that envelopes can be deposited by any user while wallets can only be deposited by authorized keyholders. Previous mechanisms for accomplishing these movements have generally been quite complicated and have required precision made moving parts.

The present invention provides a safe deposit apparatus having an effective operating mechanism which is particularly simple and robust in construction.

SUMMARY OF THE INVENTION

According to the present invention in a safe deposit apparatus of the kind referred to, the movable wall is normally biassed to its pocket-forming position and is operated by a mechanism comprising a first cam track mounted on a side wall of the casing and having a forward end rearwardly displaced from the frontal access opening; a first cam follower on the door connected to the movable wall member, the first cam follower being positioned to engage and ride along the cam track when the door is opened for retaining the wall member in its ejecting position, the cam follower disengaging the cam track at said forward end to release the wall member to form the pocket; a second cam track on the door connected to the wall member; and a second cam follower on a side wall of the casing positioned to engage the second cam track as the door is closed for displacing the wall member to its ejecting position thereby to eject articles from said pocket via the discharge opening.

BRIEF DESCRIPTION OF THE DRAWINGS

One embodiment of the invention will now be described by way of example, with reference to the accompanying drawings, in which.

DESCRIPTION OF THE PREFERRED EMBODIMENT

Figure 1:
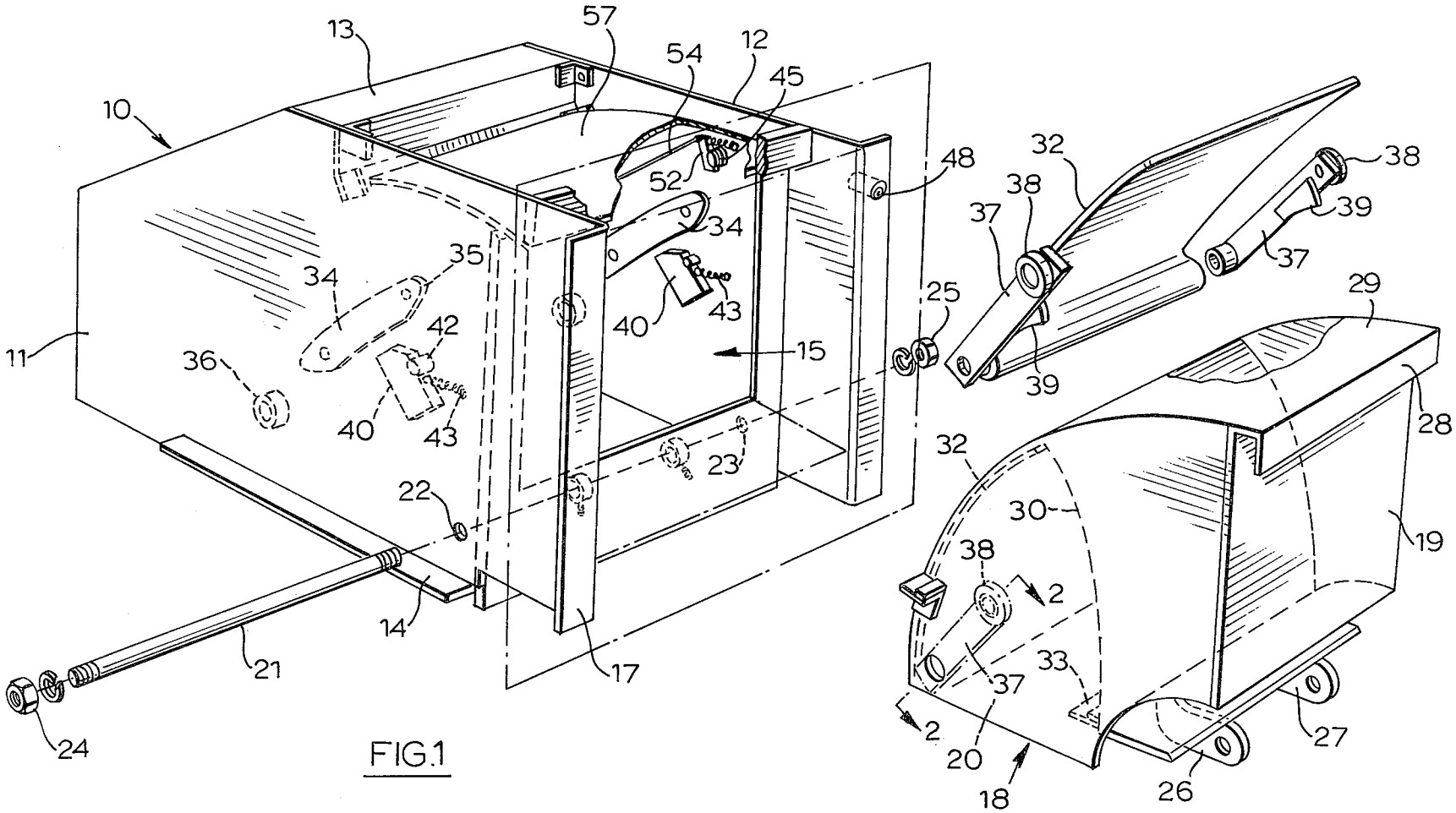
FIG. 1 is an exploded perspective view of a safe deposit apparatus according to the invention.
Figure 2:
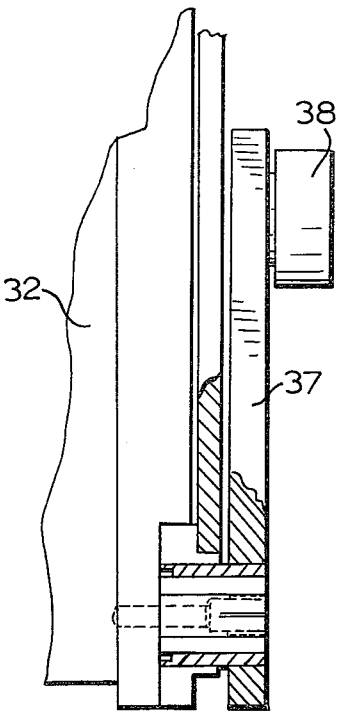
FIG. 2 is a section on line 2—2 in FIG. 1.

Referring to the drawings, there is shown a night depository comprising a casing 10 adapted to be located in the wall of a building such as a bank, the wall being provided with an opening in which the casing is anchored when installed. The casing 10 has side walls 11, 12 and upper and lower walls 13, 14, which define a door compartment having a frontal access opening 15 and a rear discharge opening 16. The rear discharge opening communicates with a duct or chute (not shown) extending to a safe or receptacle for receiving articles deposited. The frontal access opening 15 is bounded by a frame 17. Mounted in the door compartment is a sector-shaped door 18. The door 18 has an outer angle side 19 and an inner angle side 20 defining an apex, and is pivoted near its apex by a hinge pin 21 defining a horizontal pivotal axis. The hinge pin extends through holes 22, 23 in the side walls of the casing, to which it is secured by screws 24, 25, and the door is mounted on the hinge pin by mounting lugs 26, 27 on the underside of the door. In its closed position the outer angle side 19 of the door covers the frontal access opening 15, being pivoted near the bottom of said opening, and is provided with an exterior handle 28 by which the door may be pivotally moved between closed and open positions.

The door 18 further comprises an arcuate circumferential wall portion 29 extending rearwardly from the outer angle side 19 and having its radial center at the pivotal axis of the door. An arcuate radial wall portion 30 extends inwardly from the rear edge of the wall portion 29 and forms one wall of a generally V-shaped pocket 31. The pocket 31 also has a movable wall formed by an arcuate plate 32 pivotally mounted at the peripheral corner of the inner angle side 20, this movable wall normally being gravity-biassed to a first position defined by a stop 33 so as to provide the pocket 31, and being displaceable therefrom to a second position at which it lies flush with the circumferential wall portion 29. The wall 32 thus serves as an ejector for ejecting articles from the pocket 31 to discharge such articles through the rear discharge opening 16 when the door is closed. The radial wall portion 30 has its radial center at the pivotal axis of the movable wall 32, and the curvature of the movable wall 32 is such that its radial center lies at the pivotal axis of the door when the movable wall is in the second or ejecting position.

Mounted on the inside surfaces of the side walls of the casing 10 are a pair of arcuate plates defining first cam tracks 34, each of these cam tracks having a forward end 35 which is rearwardly displaced from the plane of the vertical access opening 15. A pair of rollers 36, which act as cam followers as hereinafter described, are mounted on the inside of the side walls of the casing in circumferential alignment with the cam tracks 34, these rollers also being horizontally aligned. A pair of cantilever arms 37 are rigidly connected to the movable wall 32 adjacent its pivotal axis and extend radially therefrom. Each of these cantilever arms supports a roller 38 and a cam track 39, the rollers 38 acting as cam followers which are positioned to engage and ride along the cam tracks when the door is opened for retaining the movable wall 32 in its second position; the rollers 36 are positioned to engage the cam tracks 39 as the door is closed for displacing the movable wall 32 to its second position for ejecting articles from the pocket 31 via the discharge opening 16, displacing the movable wall 32 to the ejecting position and so discharging the wallet from the pocket via the discharge opening 16.

A pair of non-return catches are mounted on the side walls of the casing and are positioned to engage the first cam followers 38 during closing of the door whereby to prevent reopening of the door prior to its being returned to the closed position. Each non-return catch is a pawl 40 horizontally pivoted on the side wall and is spring-biassed by spring 43 into engagement with an abutment stop 42 on the side wall.

Figure 3:
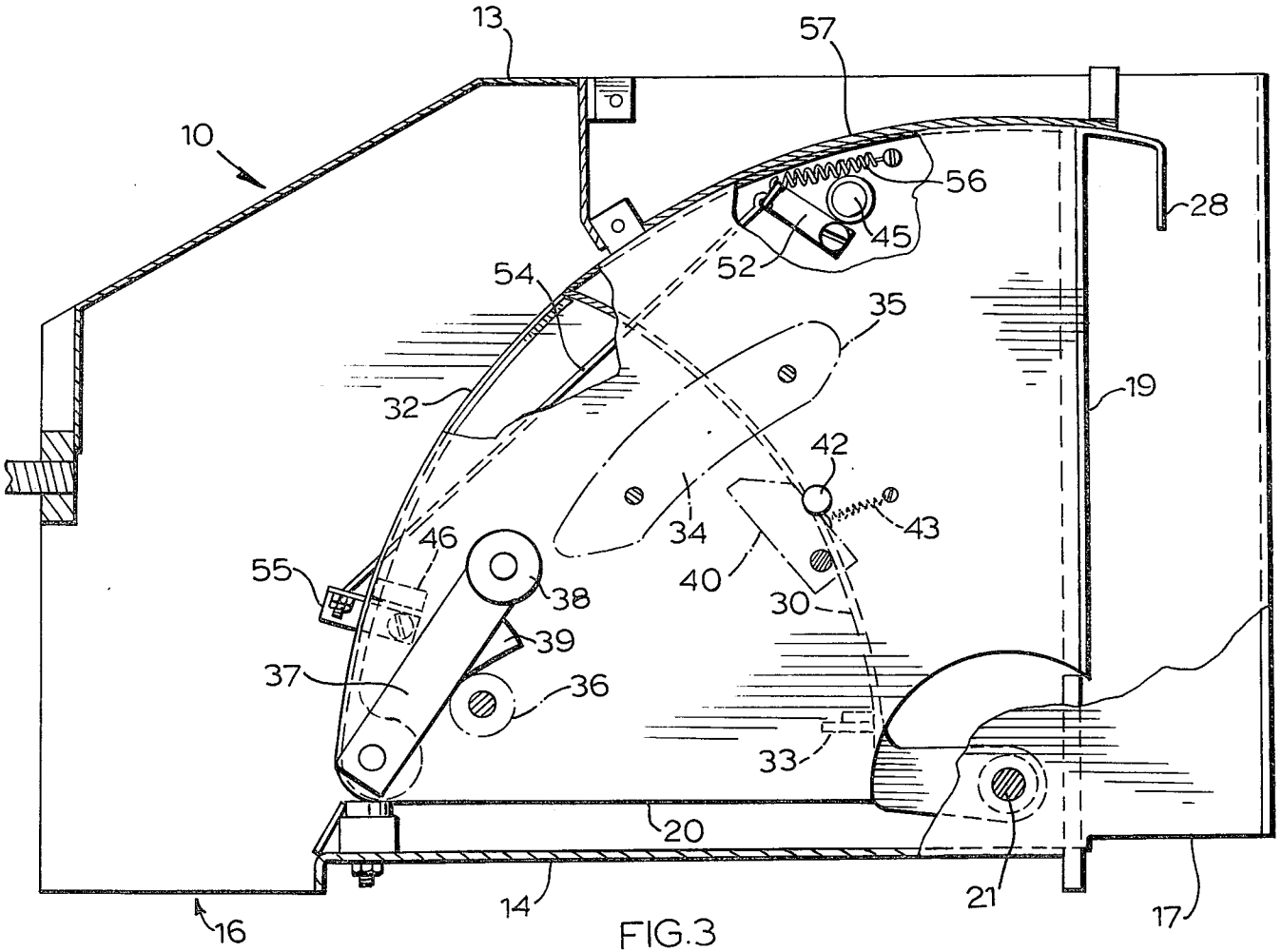
FIG. 3 is a part-sectional side elevation of the apparatus with the door in closed position.
Figure 4:
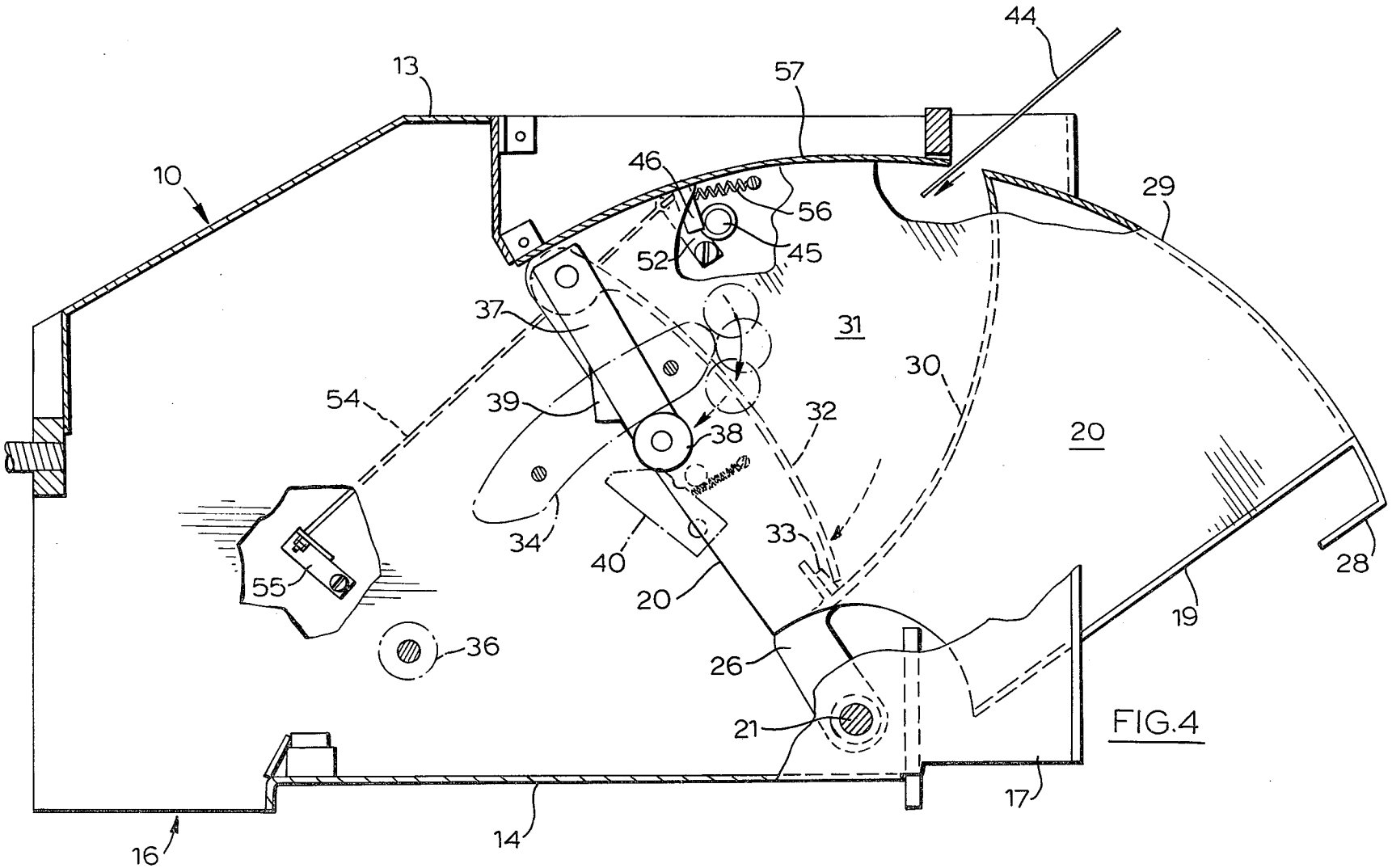
FIG. 4 is a view similar to FIG. 3 but showing the door in a first open position.
Figure 5:
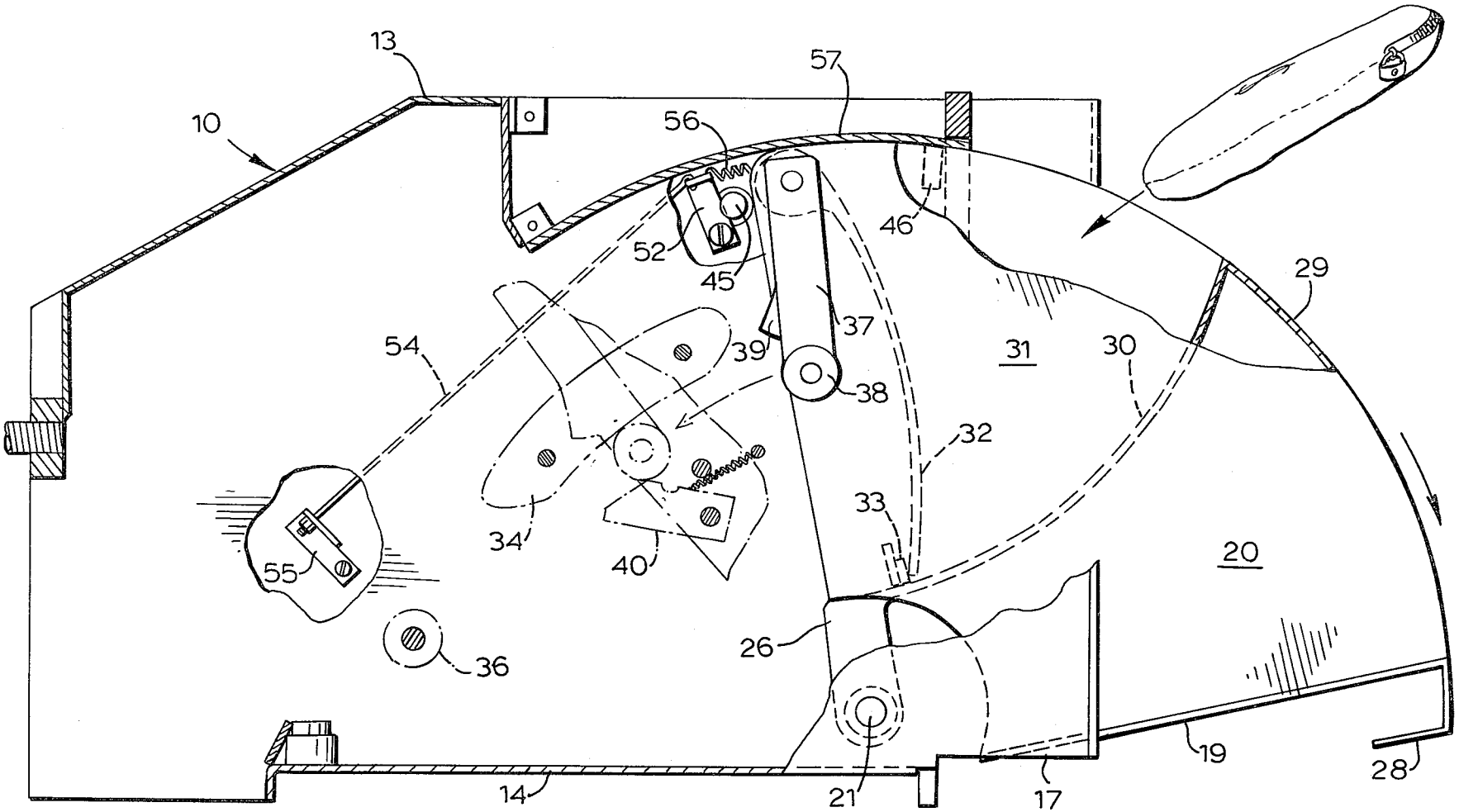
FIG. 5 is a view similar to FIG. 3 but showing the door in a second open position.
Figure 7:
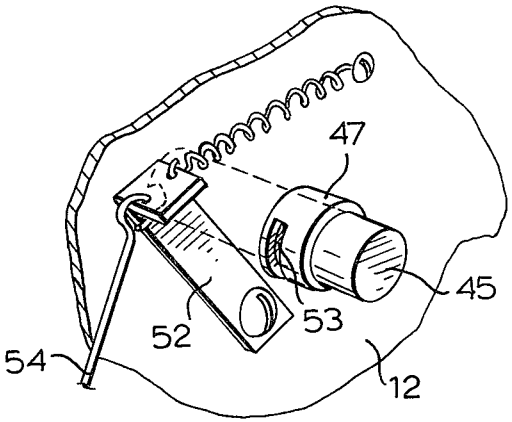
FIG. 7 is a view in the direction of arrow 7 in FIG. 6 showing a detail of the locking mechanism.
Figure 6:
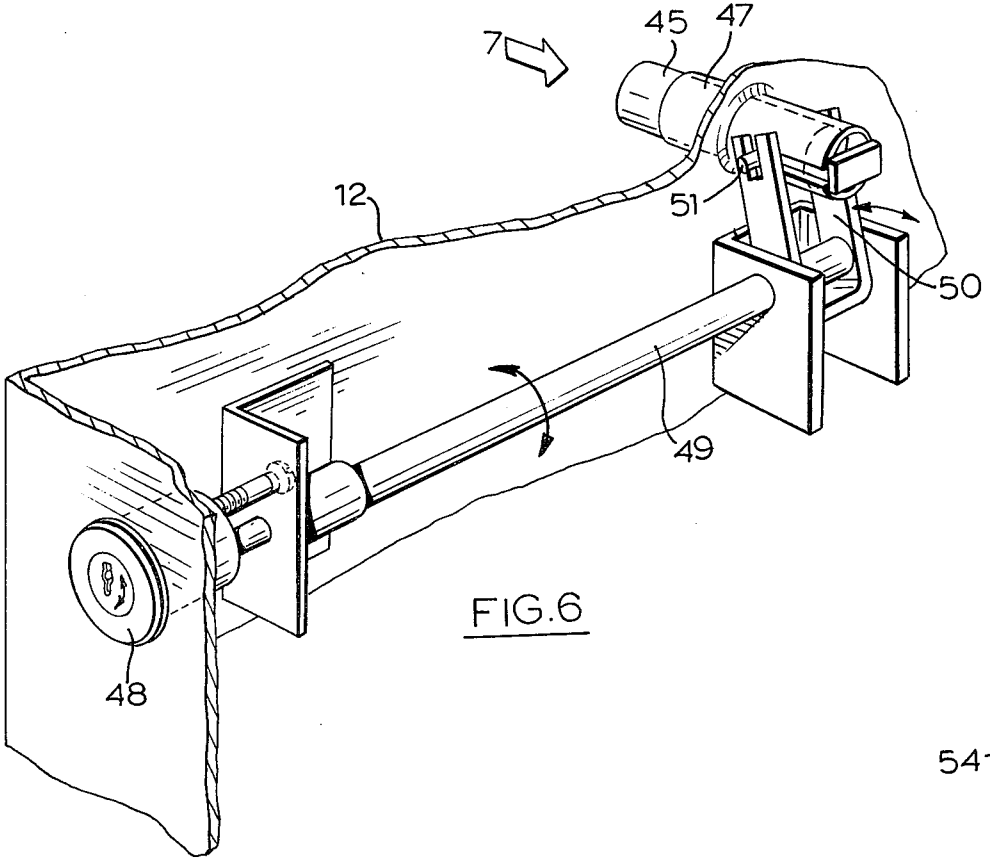
FIG. 6 is a fragmentary view of the apparatus showing in perspective the locking mechanism.

An important feature of the construction is that the user cannot withdraw the key from the lock 48 until the door has been fully closed. This is accomplished by means of a pivoted lever 52 mounted on the side wall 12 of the casing and positioned to engage an abutment in the side of the bolt 45 through a slot 53 in the sleeve 47. When the door is closed the lever 52 is held retracted, as shown in FIGS. 3 and 7, by means of a connecting rod 54 extending to a pivoted lug 55 in the casing which is engaged by the stop 46. As the door is opened, the stop 46 moves with the door to release the pivoted lug 55, and the lever 52 is pulled by a spring 56 into the slot 53 where it provides an abutment to prevent return of the bolt 45 to the locking position.

The upper wall of the casing incorporates a cowl 57 which conforms to the shape of the cylindrical wall of the door and is positioned so as to sweep the outside of the movable wall 32 when the door is opened.

It should be mentioned that in some instances financial institutions and other users of safe deposit apparatus of the type described may not wish to provide separate facilities for the depositing of envelopes. For such applications the partial opening of the door to provide limited access to the pocket 31 can be prevented by a simple modification of the lock mechanism. Thus, the bolt member 45 may be positioned so as to engage the stop 46 during the initial opening movement of the door without providing access to the pocket. In such cases, the apparatus would be operable only by authorized key-holders.

It should also be mentioned that, in accordance with standard practice, the arcuate surfaces of the wall portion 29, movable wall 32, and the cowl 57, would normally be formed with matching circumferentially extending ribs and grooves to assist the wiping action of the cowl as the door is opened. For clarity of illustration these intermeshing ribs and grooves are not shown in the drawings.

What we claim is:

1. Safe deposit apparatus comprising:

a casing defining a door compartment having a frontal access opening and a rear discharge opening;

a sector-shaped door therein horizontally pivoted at its apex axis near the bottom of said access opening, the door being pivotally movable between closed and open positions;

a handle on the outer angle side of said door;

a movable wall member horizontally pivoted near the peripheral corner of the other and inner angle side of said door;

said wall member being normally biassed to a first position at which it forms an interior pocket in the door for receiving articles deposited through said access opening when the door is in open position;

said wall member being pivotally movable from said first position towards a second position for ejecting articles from said pocket;

a first cam track mounted on a side wall of the casing and having a forward end rearwardly displaced from said access opening;

a first cam follower on said door connected to said wall member, said first cam follower being positioned to engage and ride along the cam track when the door is opened for retaining the wall member in its second position, the cam follower disengaging the cam track at said forward end to release the wall member to its first position thereby forming said pocket;

a second cam track on said door connected to said wall member; and a second cam follower on a side wall of the casing positioned to engage the second cam track as the door is closed for displacing the wall member to its second position thereby to eject articles from said pocket via said discharge opening.

2. Safe deposit apparatus according to claim 1, including a lever rigidly connected to the wall member adjacent its pivotal axis, the first cam follower being mounted on said lever and the second cam track being mounted on said lever between its pivotal axis and the first cam follower.

3. Safe deposit apparatus according to claim 2, including a non-return catch mounted on a side wall of the casing and positioned to engage the first cam follower during closing of the door whereby to prevent re-opening of the door prior to its being returned to the closed position.

4. Safe deposit apparatus according to claim 3, wherein the non-return catch is a pawl horizontally pivoted on said side wall, the pawl being spring-biassed into engagement with an abutment stop on the side wall.

5. Safe deposit apparatus according to claim 3, wherein the sector-shaped door includes an arcuate circumferential wall extending rearwardly from said inner angle side and an arcuate radial wall extending inwardly from the rear edge of the circumferential wall, the radial wall forming one wall of said pocket and having its radial center at the pivotal axis of said movable wall member.

6. Safe deposit apparatus according to claim 5, wherein the movable wall member lies flush with said circumferential wall in its second position forming an extension thereof, the movable wall member in such position having its radial center at the pivotal axis of the door.

7. Safe deposit apparatus according to claim 6, wherein the casing includes a cowl positioned to traverse the movable wall member in its second position during movement of the door from the closed to the open position.

8. Safe deposit apparatus according to claim 7, including means for locking the door in closed position.

9. Safe deposit apparatus according to claim 8, said locking means including a bolt member extending inwardly from a side wall of the casing, an abutment stop mounted on the door engageable with the bolt member, a key-operated cylinder lock mounted on a front wall of the casing, and coupling means connected between the bolt member and the cylinder lock, the cylinder lock being operable to actuate the bolt member through said coupling means for retracting the bolt member whereby to permit opening of the door.

10. Safe deposit apparatus according to claim 9, including means for retaining the bolt member in its retracted position while the door is open, said means comprising a pivoted plate mounted on the side wall of the casing adjacent the bolt member, the pivoted plate being spring-biassed to a position at which it engages the bolt to prevent locking of the bolt, a pivoted lug mounted on said side wall of the casing, the lug being connected to the bolt by a connecting rod, and the lug being engageable by said abutment stop upon return of the door to the closed position for moving the pivoted plate out of engagement with the bolt to permit return of the bolt to the locking position.

11. Safe deposit apparatus according to claim 8, said locking means including a bolt member extending inwardly from a side wall of the casing, an abutment stop mounted on the door engageable with the bolt member, the bolt member being positioned in relation to the abutment stop to permit opening of the door to a first open position a key-operated cylinder lock mounted on a front wall of the casing, and coupling means connected between the bolt member and the cylinder lock, the cylinder lock being operable to actuate the bolt member through said coupling means for retracting the bolt member whereby to permit further movement of the door to a second open position.

12. Safe deposit apparatus according to claim 11, including means for retaining the bolt member in its retracted position while the door is open, said means comprising a pivoted plate mounted on the side wall of the casing adjacent the bolt member, the pivoted plate being spring-biassed to a position at which it engages the bolt to prevent locking of the bolt, a pivoted lug mounted on said side wall of the casing, the lug being connected to the bolt by a connecting rod, and the lug being engageable by said abutment stop upon return of the door to the closed position for moving the pivoted plate out of engagement with the bolt to permit return of the bolt to the locking position.

13. Safe deposit apparatus comprising:

a casing including a pair of vertical side walls, an upper wall, and a lower wall defining a door compartment having a rectangular, generally vertical, frontal access opening and a rear discharge opening;

a sector-shaped door therein horizontally pivoted at its apex axis near the bottom of said access opening, the door being pivotally movable between closed and open positions;

means for pivotally moving the door between said closed and open positions;

means for locking the door in closed position;

a movable arcuate wall member horizontally pivoted near the peripheral corner of the other and inner angle side of said door;

said wall member being gravity biassed to a first position at which it forms an interior pocket in the door for receiving articles deposited through said access opening when the door is in closed position;

said wall member being pivotally movable from said first position towards a second position for ejecting articles from said pocket;

a pair of first cam tracks mounted on said side walls of the casing each having a forward end rearwardly displaced from said access opening;

a pair of first cam followers on said door connected to said wall member, said first cam followers being positioned to engage and ride along the cam tracks when the door is opened for retaining the wall member in its second position, the cam followers disengaging the cam tracks at said forward ends to release the wall member to its first position thereby forming said pocket;

a pair of second cam tracks on said door connected to said wall member;

a pair of second cam followers on said side walls of the casing positioned to engage the second cam tracks as the door is closed for displacing the wall member to its second position thereby to eject articles from said pocket via said discharge opening;

a pair of non-return catches mounted on the side walls of the casing and positioned respectively to engage the first cam followers during closing of the door whereby to prevent reopening of the door prior to its being returned to the closed position;

the sector-shaped door including an arcuate circumferential wall extending rearwardly from the peripheral edge of said inner angle side and an arcuate radial wall extending inwardly from the rear edge of the circumferential wall, the radial wall forming one wall of said pocket and having its radial center at the pivotal axis of said movable wall member;

the movable wall member lying flush with said circumferential wall in its second position forming an extension thereof, the movable wall member in such position having its radial center at the pivotal axis of the door;

and the casing including a cowl positioned to traverse the movable wall member in its second position during movement of the door from the closed to the open position.

* * * * *